US011506190B2

(12) United States Patent
Schoelen et al.

(10) Patent No.: US 11,506,190 B2
(45) Date of Patent: Nov. 22, 2022

(54) MULTI-STAGE HIGH PRESSURE FLANGED PUMP ASSEMBLY

(71) Applicant: GE Oil & Gas ESP, Inc., Oklahoma City, OK (US)

(72) Inventors: Matthew Allen Schoelen, Oklahoma City, OK (US); Chengbao Wang, Oklahoma City, OK (US); Colby Lane Loveless, Oklahoma City, OK (US); Vishal Gahlot, Moore, OK (US); Mark James, Oklahoma City, OK (US)

(73) Assignee: Baker Hughes ESP, Inc., Houston, TX (US)

( * ) Notice: Subject to any disclaimer, the term of this patent is extended or adjusted under 35 U.S.C. 154(b) by 1109 days.

(21) Appl. No.: 14/054,398

(22) Filed: Oct. 15, 2013

(65) Prior Publication Data

US 2015/0104337 A1 Apr. 16, 2015

(51) Int. Cl.
*F04B 35/04* (2006.01)
*F04D 29/42* (2006.01)
(Continued)

(52) U.S. Cl.
CPC ..... *F04B 35/04* (2013.01); *F04D 13/10* (2013.01); *F04D 29/426* (2013.01);
(Continued)

(58) Field of Classification Search
CPC ..... F04B 35/04; F04D 29/426; F04D 29/628; F04D 29/52–528; F04D 29/54–548; F04D 29/56–566; F04D 3/00–02; F04D 19/00–048; Y10T 403/64; Y10T 403/642; Y10T 403/645; B29C 65/56; B29C 65/561; B29C 65/562; B29C 65/76; F16L 19/02; F16L 19/0206; F16L 19/0231;
(Continued)

(56) References Cited

U.S. PATENT DOCUMENTS 1,939,936 A * 12/1933 Walker ..... F16L 13/06 285/117
2,847,941 A * 8/1958 Jackson ..... F04D 3/005 415/173.1
(Continued)

FOREIGN PATENT DOCUMENTS

DE 2458495 6/1976
WO 2012097440 7/2012

OTHER PUBLICATIONS

International Search Report and Written Opinion issued in connection with corresponding PCT Application No. PCT/US2014/055782 dated Feb. 9, 2015.

*Primary Examiner* — Essama Omgba
*Assistant Examiner* — Dnyanesh G Kasture
(74) *Attorney, Agent, or Firm* — Crowe & Dunlevy, P.C.

(57) ABSTRACT

A pump assembly for use within a high pressure pumping system includes housing, a head and a base. The housing contains at least one centrifugal pump stage. The head and base are attached to the housing with corresponding internal threaded connections. The head and base are further retained to the housing with corresponding external flanged connections. The external flanged connections provide redundant connections that reduce the risk of separation between the housing and the head and base.

7 Claims, 5 Drawing Sheets

(51) Int. Cl.
*F04D 29/62* (2006.01)
*F04D 13/10* (2006.01)

(52) U.S. Cl.
CPC ..... *F04D 29/4293* (2013.01); *F04D 29/628* (2013.01); *F05D 2230/51* (2013.01); *F05D 2260/84* (2013.01)

(58) Field of Classification Search
CPC ... F16L 19/025; F16L 19/028; F16L 19/0286; F16L 23/02; F16L 23/026; F16L 23/0286; F16L 23/16; F16L 15/00; F16L 15/006; F16L 15/001
USPC ..... 285/405–416, 82, 91, 333, 368; 29/525.01, 525.02, 525.11, 525.13
See application file for complete search history.

(56) References Cited

U.S. PATENT DOCUMENTS 3,866,954 A * 2/1975 Slator ..... F16L 15/001 285/82
4,278,399 A * 7/1981 Erickson ..... F04D 13/10 415/199.1
4,477,236 A * 10/1984 Elliott ..... F04B 53/103 417/454
5,017,087 A * 5/1991 Sneddon ..... F01D 15/08 415/221
5,297,943 A * 3/1994 Martin ..... E21B 17/025 166/66.4
5,494,413 A * 2/1996 Campen ..... F04D 3/005 417/356
6,190,141 B1 2/2001 Henry
2007/0100196 A1* 5/2007 LaRose ..... A61M 1/101 600/16
2008/0035227 A1* 2/2008 Woods ..... G01F 1/58 138/108
2008/0056883 A1* 3/2008 Lee ..... F04D 3/02 415/72
2008/0226475 A1* 9/2008 Jackson ..... B65B 3/12 417/392
2009/0013867 A1* 1/2009 McCutchen ..... B01D 45/14 95/35
2012/0169046 A1* 7/2012 Bartman ..... F16L 21/04 285/369
2015/0083427 A1* 3/2015 Pettigrew ..... E21B 43/26 166/308.1
2017/0167203 A1* 6/2017 Bowley ..... F16L 15/001

* cited by examiner

MULTI-STAGE HIGH PRESSURE FLANGED PUMP ASSEMBLY

FIELD OF THE INVENTION

This invention relates generally to the field of industrial pumping systems, and more particularly to pump systems used in high-pressure applications.

BACKGROUND

High pressure pumping systems typically include a pump assembly that is driven by an electric motor. In many designs, the pump assembly is configured as a multi-stage centrifugal pump that includes a number of impellers and diffuses stacked within a tubular housing. When energized, the motor rotates a shaft that is directly or indirectly connected to the impellers and other moving parts within the pump assembly. The rotation of the impellers imparts kinetic energy to the pumped fluid, a portion of which is converted to pressure-head as the fluid passes through the diffusers.

As shown in the PRIOR ART drawing of FIG. 1, a typical pump assembly 10 is constructed by stacking multiple turbomachine stages 12 within a tubular housing 14 that is capped on one end by a "head" 16 and on the opposing end by a "base" 18. The base 18 is usually used to secure the pump assembly 10 to an intake, motor protector or motor. The head 16 is designed to connect the pump assembly to another pump, the production tubing or some other intervening component.

Like other prior art designs, the housing 14 is connected to the head 16 and base 18 with a threaded engagement. Significantly, the engagement is created through the use of threads on the inner diameter ("ID") of the housing 14 with the threads on the outer diameter ("OD") of the head 16 and base 18. In this configuration, the head 16 and base 18 can be made to be flush with outer diameter of the housing 14. To contain the pumped fluid, o-ring seals 20 have been used in positions external to the threaded connections between the housing 14 and the head 16 and base 18.

While generally effective for lower-pressure applications, the prior art approach for connecting the pump housing to the head and base can be unsatisfactory in high-pressure installations. As the pressure of the fluid within the housing 14 increases, the housing 14 may expand, thereby decreasing the extent of engagement between housing 14 and the head 16 and base 18. If the threaded connections between the housing 14 and the head 16 and base 18 are compromised, the pump assembly 10 may operate at decreased efficiency or fail entirely and allow the head 16 and base 18 to separate from the housing 14. Accordingly, there is a need for an improved pump design that provides for increased resistance to failure at elevated working pressures.

SUMMARY OF THE INVENTION

In preferred embodiments, the present invention includes a pump assembly for use within a high pressure pumping system. In a first preferred embodiment, the pump assembly includes a housing, a head and a base. The housing contains at least one centrifugal pump stage. The head and base are attached to the housing with corresponding internal threaded connections. The head and base are further connected to the housing with corresponding external flanged connections. The external flanged connections provide redundant connections that reduce the risk of failure between the housing and the head and base.

In a second preferred embodiment, the invention includes a modular pump assembly that includes a first pump module connected to a second pump module. The first pump module includes a first housing that has a first pair of external flanges located at opposing ends of the first housing. The first pump module further includes a head enclosed within the first housing and a base enclosed within the first housing. Similarly, the second pump module includes a second housing that has a second pair of external flanges located at opposing ends of the second housing. The second pump module includes a head enclosed within the second housing and a base enclosed within the second housing. The second pump module is connected to the first pump module by securing one of the second pair of external flanges is connected to one of the first pair of external flanges.

Thus, the preferred embodiments include pump assemblies that include the use of external flanged connections to back-up the internal threaded connections between the pump head, base and housing.

DETAILED DESCRIPTION OF THE PREFERRED EMBODIMENTS

Figure 1:
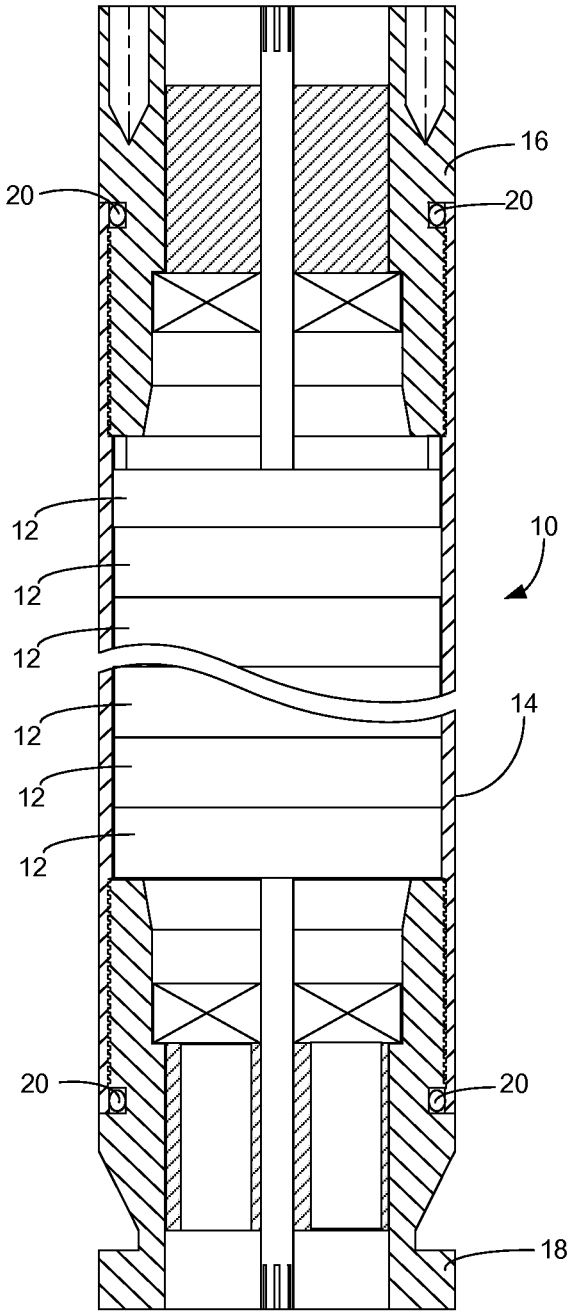
FIG. 1 PRIOR ART
FIG. 1 is a cross-sectional view of a PRIOR ART pump assembly.
Figure 2:
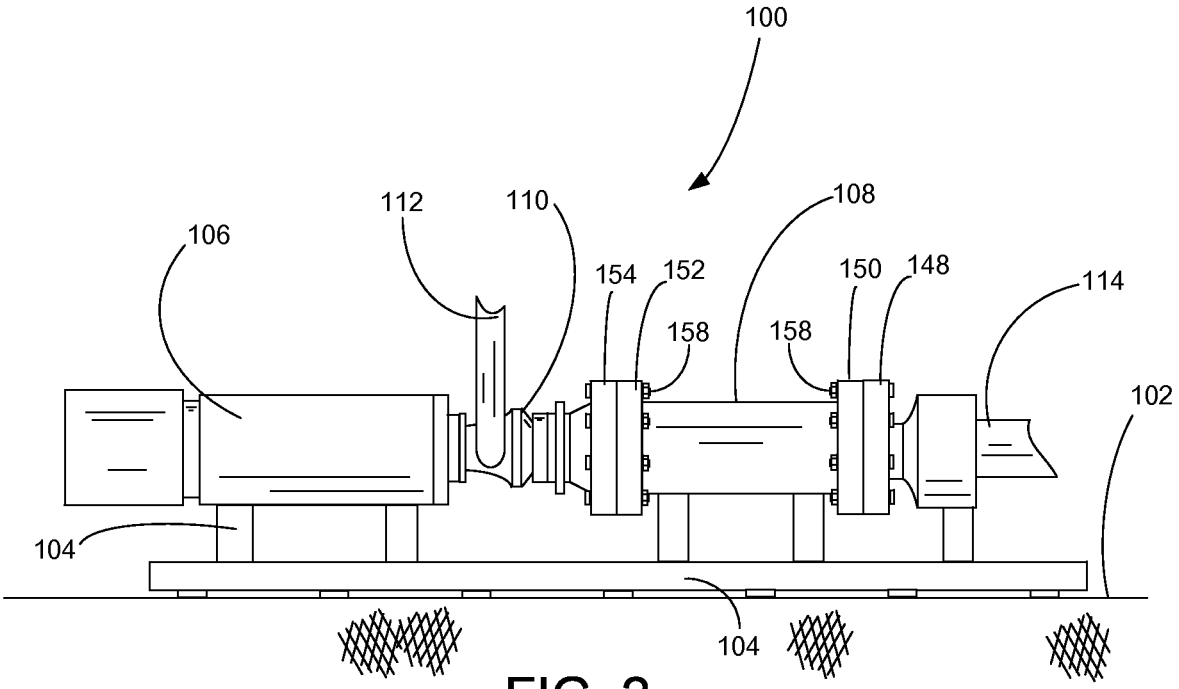
FIG. 2 is a depiction of a pumping system constructed in accordance with a preferred embodiment of the present invention in a surface-mounted application.

In accordance with a preferred embodiment of the present invention, FIG. 2 shows a side view of a pumping system 100. As shown in FIG. 2, the pumping system 100 is configured as a surface pumping system supported on the surface 102 by a support rack 104. The surface-mounted pumping system 100 preferably includes a motor 106, a pump assembly 108 and an intake 110. The pumping system 100 further includes an intake manifold 112 and a discharge manifold 114 that carry fluid to and from the surface pumping system 100, respectively.

Figure 3:
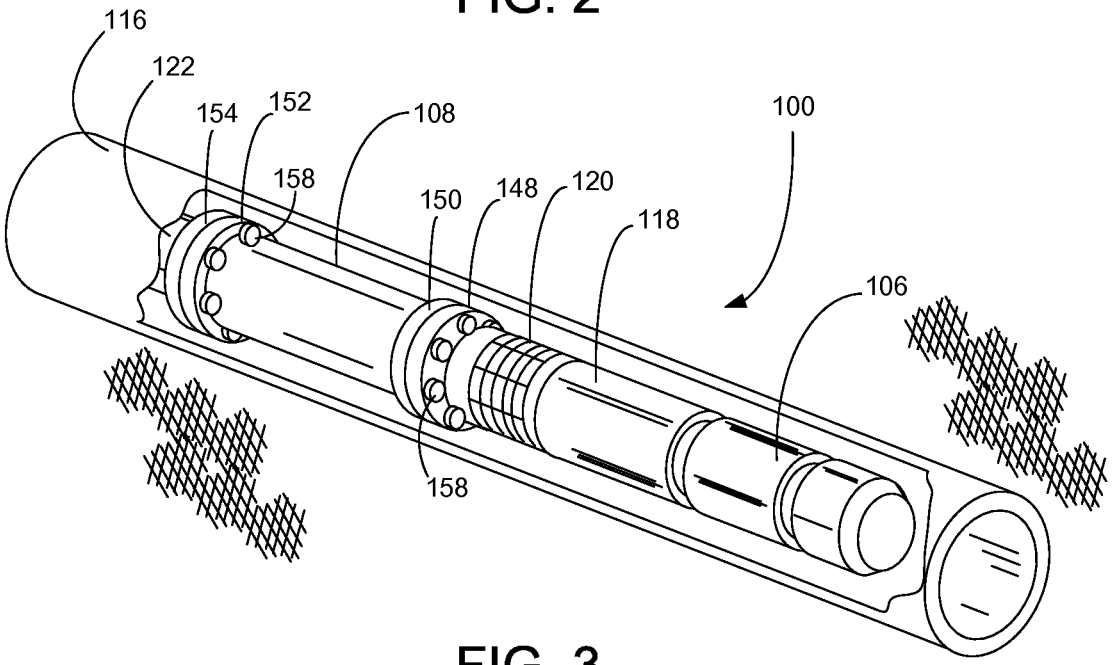
FIG. 3 is a front perspective view of a pumping system constructed in accordance with a preferred embodiment of the present invention in a subterranean application.

Turning now also to FIG. 3, shown therein is a perspective view of the pumping system 100 in a subterranean application. As shown in FIG. 3, the pumping system 100 is located within a casing 116 of an underground wellbore, which is drilled for the production of a fluid such as water or petroleum. As used herein, the term "petroleum" refers broadly to all mineral hydrocarbons, such as crude oil, gas and combinations of oil and gas.

The pumping system 100 of FIG. 3 preferably includes a seal section 118 and a screened intake 120 between the motor 106 and pump assembly 108. The seal section 118 protects the motor 106 from thrust produced by the pump assembly 108 and the unwanted ingress of contaminated fluids from the wellbore environment and accommodates the expansion of lubricants within the motor 106. The screened intake 120 provides an inlet through which fluids can pass from the wellbore into the pump assembly 108. In this environment, the pumping system 100 also preferably includes production tubing 122 that provides a conduit through which fluids are pumped from the pump assembly 108 to the surface 102.

In a preferred embodiment, the motor 106 is an electrical motor that receives its power from a surface-based source. Generally, the motor 106 converts electrical energy into mechanical energy, which is transmitted to the pump assembly 108 through one or more shafts (not shown in FIG. 2 or 3). In a particularly preferred embodiment, the pump assembly 108 is a multi-stage centrifugal pump that uses two or more impellers and diffusers to convert mechanical energy into pressure head. In an alternative embodiment, the pump assembly 108 is a progressive cavity (PC) pump that moves wellbore fluids with one or more screws or pistons.

Figure 4:
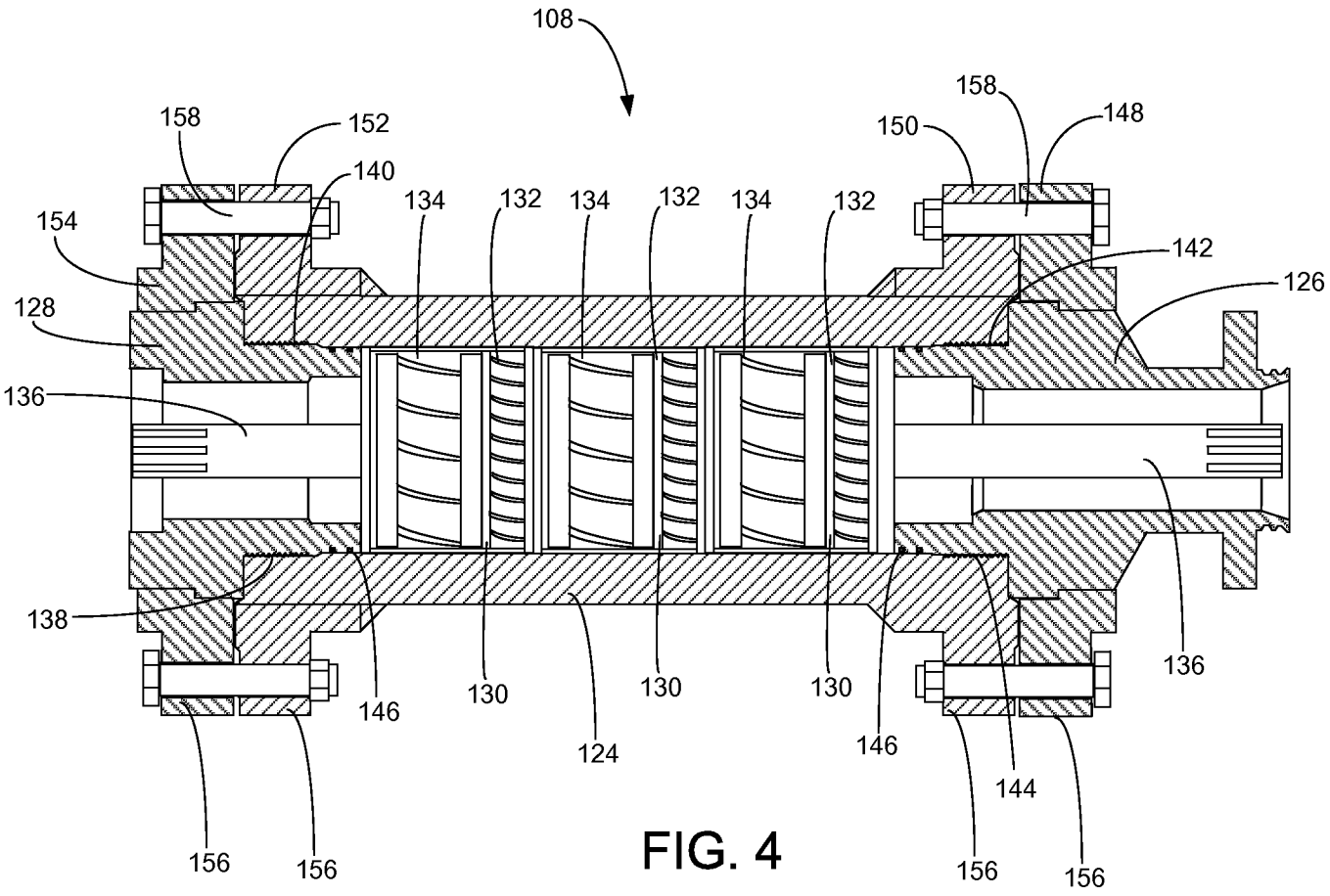
FIG. 4 is a cross-sectional view of a first preferred embodiment of the pump assembly from the pumping systems of FIG. 2 or 3.

Turning to FIG. 4, shown therein is a cross-sectional depiction of the pump assembly 108 constructed in accordance with a first preferred embodiment. The pump assembly 108 preferably includes a housing 124, a base 126 and a head 128. The base 126 is preferably configured for attachment to the intake 110 or screened intake 120, depending on the environment in which the pump assembly 108 is used. The head 128 is preferably configured for attachment to the discharge manifold 114 or the production tubing 122, again depending on the environment in which the pumping system 100 is used. The head 128 can be used alternatively or additionally as an bearing support that is configured for threaded engagement with the housing 124. The housing 124 is preferably constructed as a tubular, substantially cylindrical member that contains at least one turbomachinery stage 130. Each turbomachinery stage 130 preferably includes an impeller 132 and a diffuser 134. Each impeller 132 is connected to and configured for rotation with a shaft 136 that extends through the pump assembly 108.

The head 128 includes exterior head threads 138 that mate with interior head threads 140 on the inside of the housing 124. Similarly, the base 126 includes exterior base threads 142 that mate with interior base threads 144 on the interior of the housing 124. In this way, the head 128 and base 126 can be screwed into the housing 124 to place a compressive load on the diffuser 134 portion of turbomachinery stages 130. The compressive load prevents the diffuser 134 from spinning within the housing 124. The head 128 and base 126 each further include one or more o-ring seals 146 to prevent the passage of fluid through the threaded connection.

The pump assembly 108 further includes a base flange 148 on the base 126, an upstream flange 150 on the housing 124, a downstream flange 152 on the housing 124 and a head flange 154 on the head 128 (collectively, "exterior flanges 148, 150, 152 and 156"). The base flange 148 is preferably slip-fit up to the load shoulder on the exterior surface of the base 126. The upstream flange 150 and downstream flange 152 are preferably shrink-fit then welded to the exterior surface of opposing upstream and downstream ends of the housing 124. Alternatively, the upstream flange 150 and downstream flange 152 can be formed with the housing 124 in unitary construction from a single piece of material. The head flange 154 is preferably welded to the outside of the head 128. Each of the base flange 148, upstream flange 150, downstream flange 152 and head flange 154 are preferably configured as circular flanges that each contain a series of aligned bolt holes 156. Bolts 158 or other suitable fasteners can be placed through the bolts holes 156 to provide back-up retaining force between the base 126 and housing 124 and between the housing 124 and head 128.

In this way, the pump assembly 108 includes both exterior flanged and interior threaded connections between the housing 124 and the each of the base 126 and head 128. The use of interior threaded connections and exterior flanged connections provides a robust pump assembly 108 that is capable of performing at pressures of up to about 10,000 psi.

Figure 5:
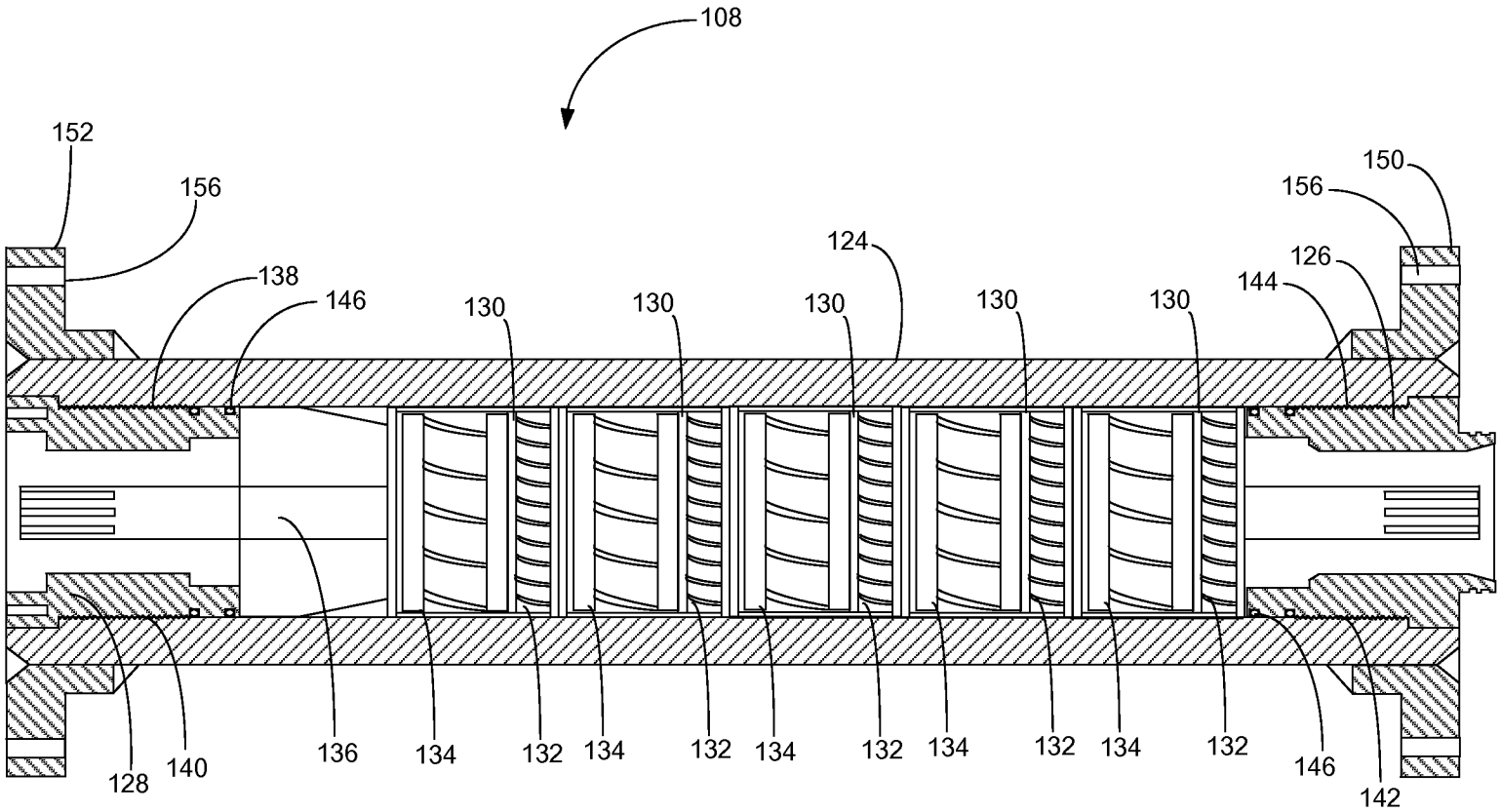
FIG. 5 is a cross-sectional view of a second preferred embodiment of the pump assembly from the pumping systems of FIG. 2 or 3.
Figure 6:
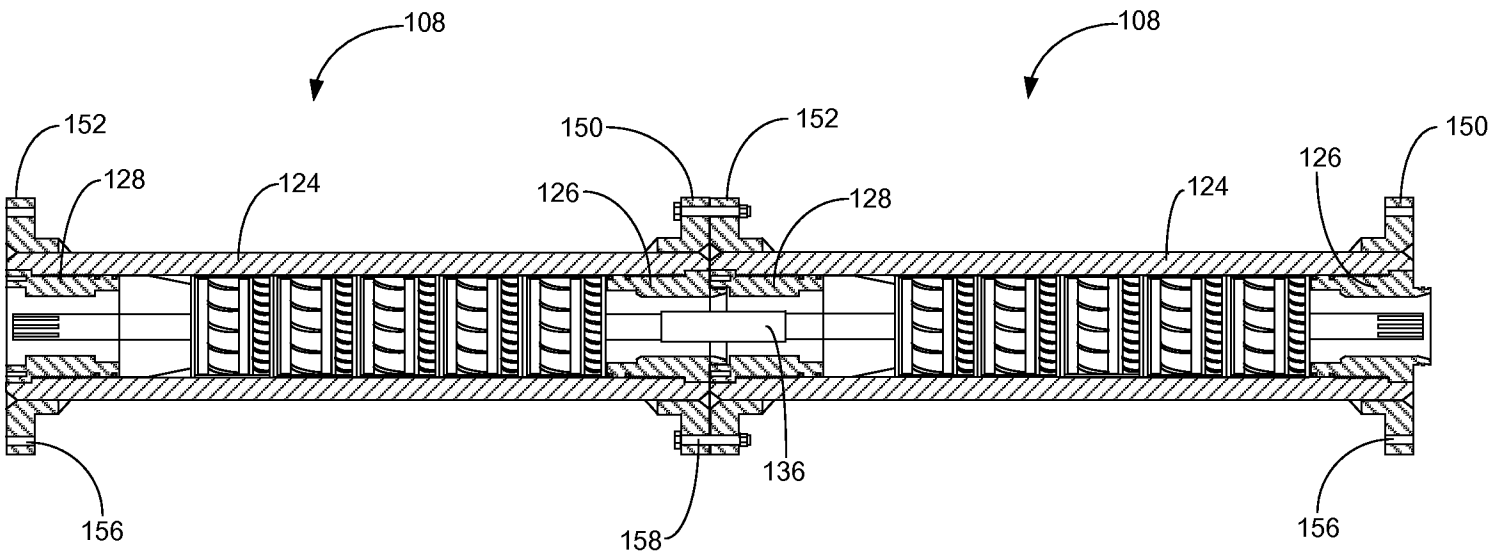
FIG. 6 is a cross-sectional view of the two of the second preferred embodiment of the pump assemblies of FIG. 5 ganged together.

Turning to FIGS. 5 and 6, shown therein is a side cross-sectional view of a second preferred embodiment of the pump assembly 108. In the second preferred embodiment, the head 128 and base 126 are secured within the interior of the housing 124 by interior and exterior head threads 138, 140 and interior and exterior base threads 142, 144. The housing 124 further encloses one or more centrifugal pump stages 130. Because the head 128 and base 126 are internal to the housing 124, the pump assembly 108 of the second preferred embodiment does not include the base flange 148 and head flange 154. Instead, the pump assembly 108 includes only the upstream flange 150 and downstream flange 152 connected to the exterior of the housing 124 at the opposing upstream and downstream ends. In particularly preferred embodiments, the upstream flange 150 and downstream flange 152 are welded to the exterior of the housing 124.

As illustrated in FIG. 6, the second preferred embodiment of the pump assembly is particularly well suited for use in a modular pumping system in which multiple pumps are connected together. The use of the exterior flanges 150, 152 retains the axial loads produced between and by adjacent pump assemblies 108. The internal forces within the pump assembly 108 are retained by the head 128 and base 126, through the interior and exterior head threads 138, 140 and interior and exterior base threads 142, 144. The use of external flanges 150, 152 increases the pump connection joint contact area and, provides back-up to the internal threaded connections between the housing 124 and the head 128 and base 126. The exterior flanges 150, 152 on the opposing terminal ends of the concatenated pump assemblies 108 can be used for connection to the intake manifold 112, discharge manifold 114, intake 120 and/or production tubing 122. The second preferred embodiment of the pump assembly 108 is capable of withstanding operating pressures of up to about 10,000 psi.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

It is claimed:

1. A surface pumping system comprising:

an electric motor;

a support frame;

a pump assembly connected to the electric motor and supported by the support frame, wherein the pump assembly comprises:

a pump housing, wherein the pump housing comprises a tubular member having an exterior, an interior, an upstream end and a downstream end, wherein the pump housing comprises:

interior base threads at the upstream end;

interior head threads at the downstream end;

an upstream flange connected to the exterior of the upstream end; and a downstream flange connected to the exterior of the downstream end;

a pump base fastened to the upstream end of the pump housing with a redundant base connection, wherein the redundant base connection comprises:

a base flange matingly connected to the pump base in direct physical contact, wherein the base flange is fastened to the upstream flange; and exterior base threads in mating engagement with the interior base threads; and a pump head fastened to the downstream end of the pump housing with a redundant head connection, wherein the redundant head connection comprises:

a head flange matingly connected to the pump head in direct physical contact, wherein the head flange is fastened to the downstream flange; and exterior head threads in mating engagement with the interior head threads.

2. The surface pumping system of claim 1, wherein the pump assembly further comprises:

a shaft; and a plurality of turbomachinery stages, wherein each of the plurality of turbomachinery stages includes a rotatable impeller connected to the shaft and a stationary diffuser connected to the pump housing.

3. The surface pumping system of claim 1, wherein the pump assembly further comprises one or more o-ring seals between the pump head and the pump housing.

4. The surface pumping system of claim 1, wherein the pump assembly further comprises one or more o-ring seals between the pump base and the pump housing.

5. The surface pumping system of claim 1, wherein the base flange is connected to the upstream flange with a plurality of tensioned bolts.

6. The surface pumping system of claim 1, wherein the head flange is connected to the downstream flange with a plurality of tensioned bolts.

7. The surface pumping system of claim 1 further comprising:

an intake manifold connected to the pump base; and a discharge manifold connected to the pump head.

* * * * *